US010590611B2

(12) United States Patent
Kim

(10) Patent No.: US 10,590,611 B2
(45) Date of Patent: Mar. 17, 2020

(54) WATER-COLLECTING BOUNDARY BLOCK

(71) Applicant: MY'S TECH CO. LTD., Gyeonggi-do (KR)

(72) Inventor: Jin Hwan Kim, Gyeonggi-do (KR)

(73) Assignee: MY'S TECH CO. LTD., Gyeonggi-Do (KR)

( * ) Notice: Subject to any disclaimer, the term of this patent is extended or adjusted under 35 U.S.C. 154(b) by 0 days.

(21) Appl. No.: 16/329,541

(22) PCT Filed: Aug. 29, 2017

(86) PCT No.: PCT/KR2017/009408
§ 371 (c)(1),
(2) Date: Feb. 28, 2019

(87) PCT Pub. No.: WO2018/044026
PCT Pub. Date: Mar. 8, 2018

(65) Prior Publication Data

US 2019/0226160 A1 Jul. 25, 2019

(30) Foreign Application Priority Data

Aug. 29, 2016 (KR) ..... 10-2016-0109724

(51) Int. Cl.

| | |
|---|---|
| ***E01C 11/22*** | (2006.01) |
| ***E03F 5/06*** | (2006.01) |
| ***E03F 1/00*** | (2006.01) |
| ***E03F 5/04*** | (2006.01) |

(52) U.S. Cl.
CPC ..... *E01C 11/223* (2013.01); *E01C 11/22* (2013.01); *E03F 1/00* (2013.01); *E03F 1/002* (2013.01); *E03F 5/04* (2013.01); *E03F 5/06* (2013.01)

(58) Field of Classification Search
CPC ..... E01C 11/223; E01C 11/22; E03F 5/04; E03F 5/06; E03F 1/00; E03F 1/002
See application file for complete search history.

(56) References Cited

U.S. PATENT DOCUMENTS 3,626,823 A * 12/1971 Toth ..... E01C 11/223 404/4
4,610,566 A * 9/1986 Albang ..... E01C 19/506 249/1
4,934,865 A * 6/1990 Varkonyi ..... E02B 11/00 405/267

(Continued)

FOREIGN PATENT DOCUMENTS

JP 2001-279607 A 10/2001
KR 10-0922895 B1 10/2009

(Continued)

OTHER PUBLICATIONS

International Search Report for PCT/KR2017/009408 dated Dec. 5, 2017.

*Primary Examiner* — Abigail A Risic
(74) *Attorney, Agent, or Firm* — The PL Law Group, PLLC

(57) ABSTRACT

A water collecting boundary block includes a body having an opened upper portion and a space portion formed therein, a grating which is seated on the body, and through which a plurality of rainwater inlets are formed, and a drain part formed at one side of a lower end of the body so as to be connected to the space portion, to provide water stored in the space portion to a ground.

11 Claims, 9 Drawing Sheets

(56) References Cited

U.S. PATENT DOCUMENTS 5,730,179 A * 3/1998 Taylor ..... E03B 3/03 137/357
8,474,195 B1 * 7/2013 Anchondo ..... E03B 3/03 52/168
9,279,271 B2 * 3/2016 McDowell ..... E04H 17/00
2005/0100412 A1 * 5/2005 Houck ..... E02B 11/005 405/124
2009/0208286 A1 * 8/2009 Sutton ..... E01C 11/223 404/7
2011/0088791 A1 * 4/2011 Primm, Jr. ..... E04D 13/08 137/356
2011/0198273 A1 * 8/2011 Snyder ..... E03F 5/0404 210/163
2012/0000546 A1 * 1/2012 Lewis ..... E03B 1/04 137/15.01
2012/0279583 A1 * 11/2012 Forrest ..... E03B 3/03 137/357
2013/0233862 A1 * 9/2013 Morris ..... E03B 3/03 220/565
2014/0034152 A1 * 2/2014 Drummond ..... E03B 3/03 137/363
2014/0154006 A1 * 6/2014 Thomas ..... E03F 5/046 404/4
2016/0289913 A1 * 10/2016 Canney ..... E05B 35/008
2017/0241145 A1 * 8/2017 Gomo ..... B66B 13/301
2018/0038091 A1 * 2/2018 Ismert ..... E03F 5/0404
2018/0209132 A1 * 7/2018 Dian ..... E03F 3/046
2018/0235158 A1 * 8/2018 Iorio ..... E01C 5/20
2019/0024358 A1 * 1/2019 Meincke ..... E01C 11/223
2019/0186117 A1 * 6/2019 Lacouture ..... E03F 5/0404

FOREIGN PATENT DOCUMENTS

KR 10-0930686 B1 12/2009
KR 10-2011-0100805 A 9/2011
KR 20-2011-0010729 U 11/2011

* cited by examiner

WATER-COLLECTING BOUNDARY BLOCK

CROSS REFERENCE TO RELATED APPLICATIONS AND CLAIM OF PRIORITY

This application claims benefit under 35 U.S.C. 119(e), 120, 121, or 365(c), and is a National Stage entry from International Application No. PCT/KR2017/009408, filed Aug. 29, 2017, which claims priority to the benefit of Korean Patent Application No. 10-2016-0109724 filed in the Korean Intellectual Property Office on Aug. 29, 2016, the entire contents of which are incorporated herein by reference.

TECHNICAL FIELD

Exemplary embodiments of the inventive concept relate to a water collecting boundary block. More particularly, exemplary embodiments of the inventive concept relate to a water collecting boundary block capable of effective rainwater management and controlling of the growth of roadside roots.

BACKGROUND ART

A rainwater collecting system installed for rapid drainage of rainwater includes a collecting well and a drainage line. In the rainwater collecting system, the collecting well provided on a side of the road is connected to a sewage main pipe on a lower side, and the drainage line is provided on an upper side, so that rainwater flows along the drainage line, flows naturally into the collecting well, and flows into the sewage main pipe.

Upper parts of the collecting well and drainage line of the system of the rainwater collecting system is generally finished by grating so that people can safely pass through while passing rainwater through them. At this time, for the installation of the grating, a frame for vertical compressive load on the road surface is installed on the upper parts of the collecting well and drainage line, and the grating is seated on a supporting part of the frame.

However, the grating and the frame are also provided for protecting the trees that are planted around the road to secure the beauty of the city. In general, a plurality of frames are disposed so as to surround the periphery of the tree, and are installed in such a manner that the grating is seated in the frame. At this time, since the roots of the trees are grown together with the trees, so that the roots infiltrate the sidewalk blocks or the roads, and the roots and the sidewalk blocks or roads of the trees are damaged.

As a result, there are problems that the management of the tree is costly, the safety accident occurs, the destruction of the urban infrastructure proceeds. On the other hand, due to the rapid drainage of the rainwater collecting system, the rainwater can not sufficiently penetrate into the ground, so that the soil is cemented and the tree is damaged due to lack of water in a period of water shortage.

SUMMARY

One or more exemplary embodiment of the inventive concept provides a water collecting boundary block having excellent collecting efficiency and capable of preventing desertification in urban areas.

One or more exemplary embodiments of the inventive concept also provide a water collecting boundary block capable of preventing expansion of a root of a tree and death of the tree.

One or more exemplary embodiments of the inventive concept also provide a water collecting boundary block capable of controlling amount of water supplied to the ground.

One or more exemplary embodiments of the inventive concept also provide a water collecting boundary block capable of preventing foreign matter from entering.

One or more exemplary embodiments of the inventive concept also provide a water collecting boundary block capable of storing rainwater and passing the rainwater through soil.

One or more exemplary embodiments of the inventive concept also provide a water collecting boundary block capable of passing the rainwater through a drain pipe to prevent over capacity.

Solution to Problem

According to an exemplary embodiment of the inventive concept, a water collecting boundary block includes a body having an opened upper portion and a space portion formed therein, a grating which is seated on the body, and through which a plurality of rainwater inlets are formed, and a drain part formed at one side of a lower end of the body so as to be connected to the space portion, to provide water stored in the space portion to a ground.

In an exemplary embodiment, the water collecting boundary block may further include a water supply pipe connected to the space portion and formed at an upper portion of the drain part, and wherein a cap is combined with an upper portion of the water supply pipe which is exposed to the ground to provide water to the space part.

In an exemplary embodiment, the drain part may include a flow control member for regulating an amount of water supplied to the ground.

In an exemplary embodiment, the water collecting boundary block may further include a urethane having a void or a water-permeable concrete, and received in the space portion In an exemplary embodiment, the water collecting boundary block may further include a connecting part is formed at one side of an upper portion of the body so as to be connected with the space portion, to flow out water to another adjacent water collecting boundary block or a drain pipe when water in the space portion is full.

In an exemplary embodiment, the water collecting boundary block may further include a connecting hole formed at the other side of the upper portion of the body so as to be connected with the connecting part.

In an exemplary embodiment, the water collecting boundary block may further include a combining part for combination with a root expansion preventing member or a combination bracket.

In an exemplary embodiment, the water collecting boundary block may further include a filter container having a bottom surface and side walls in which a filter is received and combined with an upper side of the space portion, wherein a plurality of inlets are formed at the bottom surface of the filter container.

In an exemplary embodiment, the grating may include a cover having a plurality of rainwater inlets formed at a ceiling surface thereof, and a plurality of flaps which are combined with inner side of the ceiling surface in a hinge manner to be rotated in up-down direction. The flap may be elastically supported in a direction toward the rainwater inlets to open and close the rainwater inlets.

In an exemplary embodiment, the body may include a seating portion respectively formed by inwardly bended at both upper ends of the body in a longitudinal direction, at least one inserting protrusion protruded from the seating portion and at least one supporting step protruded from an inner side surface thereof. A lattice net may be seated on an upper side of the supporting step, and a nonwoven filter is seated on an upper side of the lattice net.

In an exemplary embodiment, the cover may have a form of a box with opened bottom. The cover may include a flange portion protruded outward and extending a length direction so as to have a predetermined width at a lower end of one side in a width direction, a supporting portion extending inwardly by a predetermined length at both ends in the length direction, and a inserting groove formed at the supporting portion. When the body and the grating may be combined, the inserting protrusion of the body is coupled to the inserting groove of the cover to prevent the grating from flowing.

According to the water collecting boundary block according to the present invention, since rainwater is collected into a body through a grating, collecting efficiency may be improved.

In addition, since water stored in the space portion is continuously supplied to ground through the drain part, the water collecting boundary block may prevent desertification in urban areas and death of a tree.

In addition, according to the water collecting boundary block according to the present invention, amount of water supplied to the ground through the drain part can be adjusted.

In addition, according to the water collecting boundary block according to the present invention, water can be continuously supplied to the ground by supplying water to the space portion of the body through a water supply pipe exposed to the ground even in drought and the like.

In addition, according to the water collecting boundary block according to the present invention, since a rainwater inlet of the grating is opened and closed by a flap, foreign substances such as dust and leaves can be prevented from flowing into the space portion of the body.

In addition, according to the water collecting boundary block according to the present invention, when the water stored in the space portion is overflowed, it can flow out to another adjacent water collecting boundary block or a drain pipe.

DETAILED DESCRIPTION OF THE INVENTION

Figure 1:
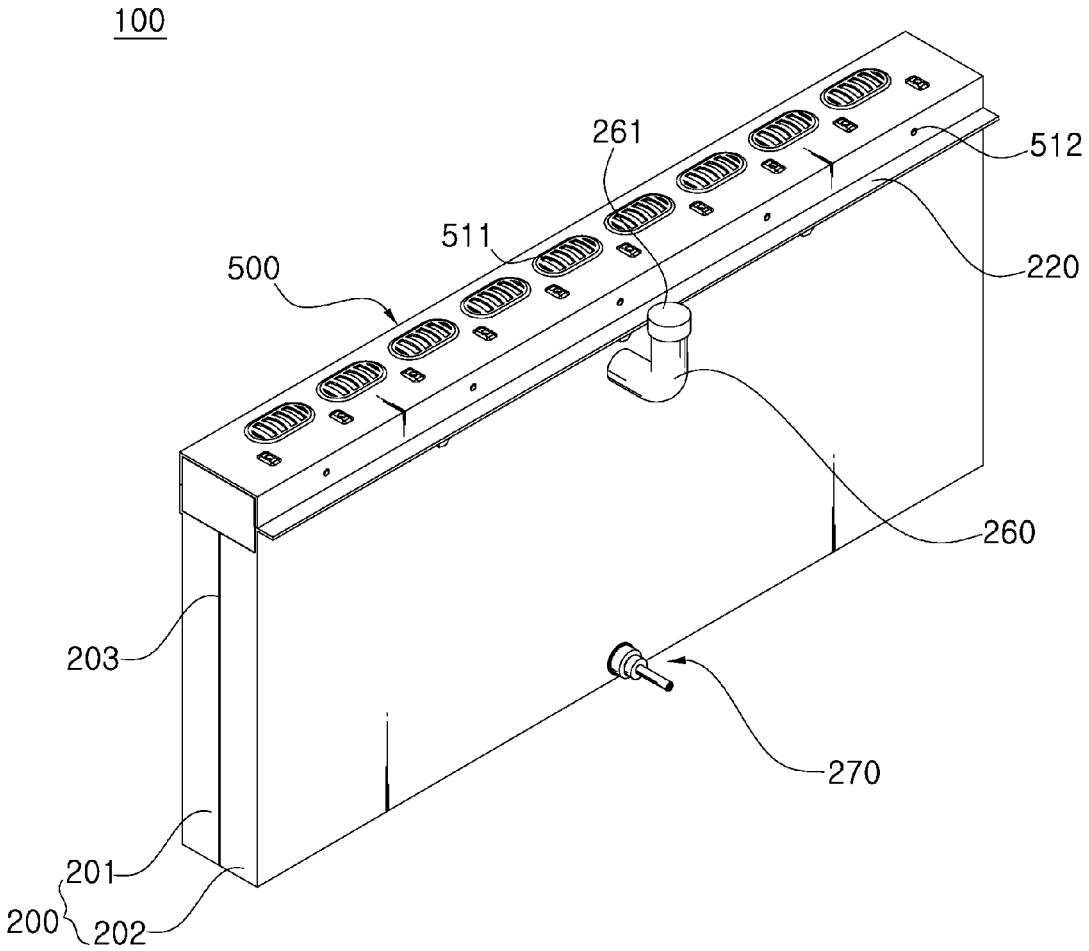
FIG. 1 is a perspective view of a water collecting boundary block according to a first embodiment of the present invention.

Hereinafter, the inventive concept will be explained in detail with reference to the accompanying drawings. It is to be understood, however, that the embodiments described below are only for explanation of the embodiments of the present invention so that those skilled in the art can easily carry out the invention, and this does not mean that the scope of protection of the present invention is limited. In describing various embodiments of the present invention, the same reference numerals are used for elements having the same technical characteristics.

First Embodiment

Figure 2:
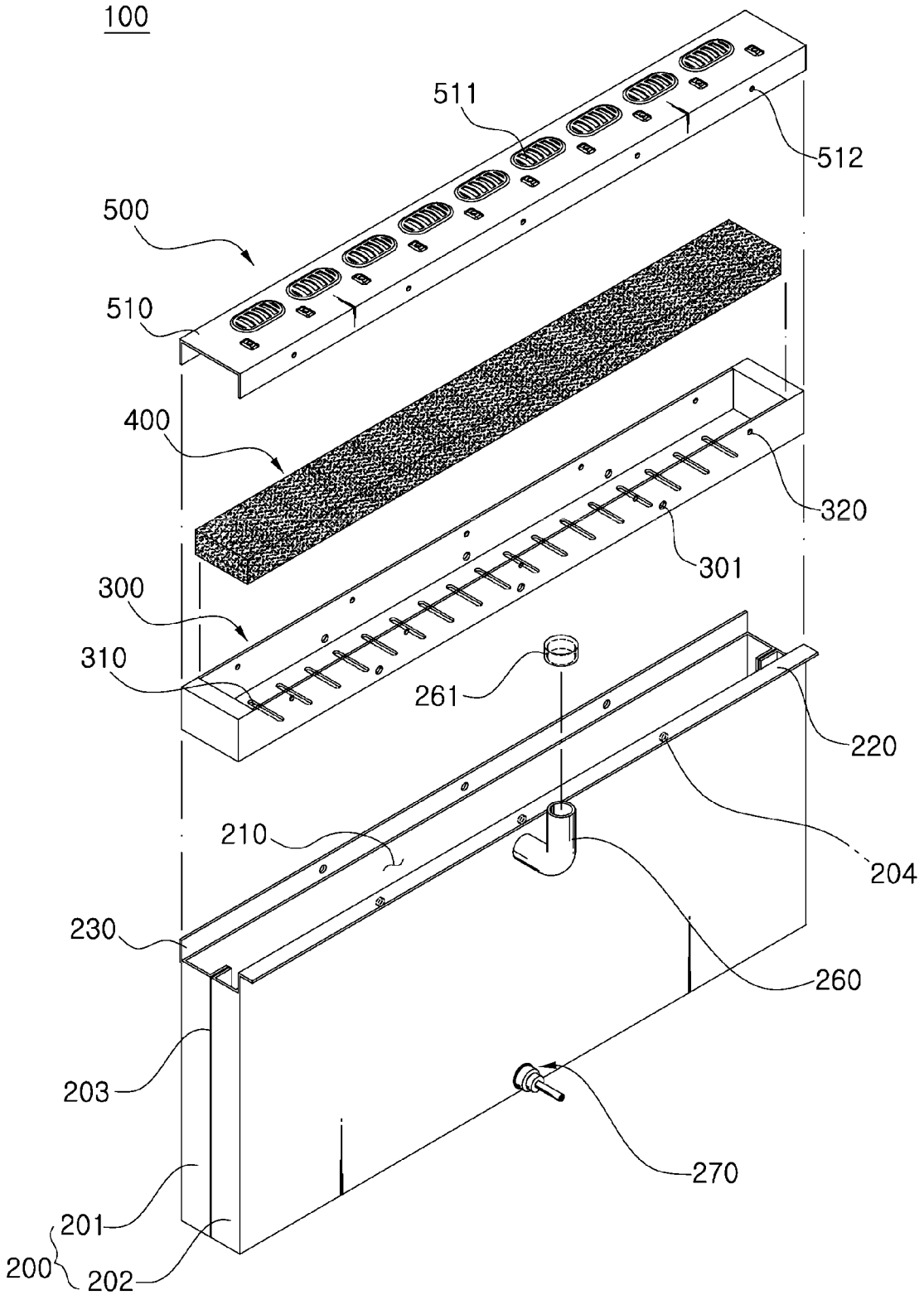
FIG. 2 is an exploded perspective view of FIG. 1.

FIG. 1 is a perspective view of a water collecting boundary block according to a first embodiment of the present invention. FIG. 2 is an exploded perspective view of FIG. 1.

Figure 3:
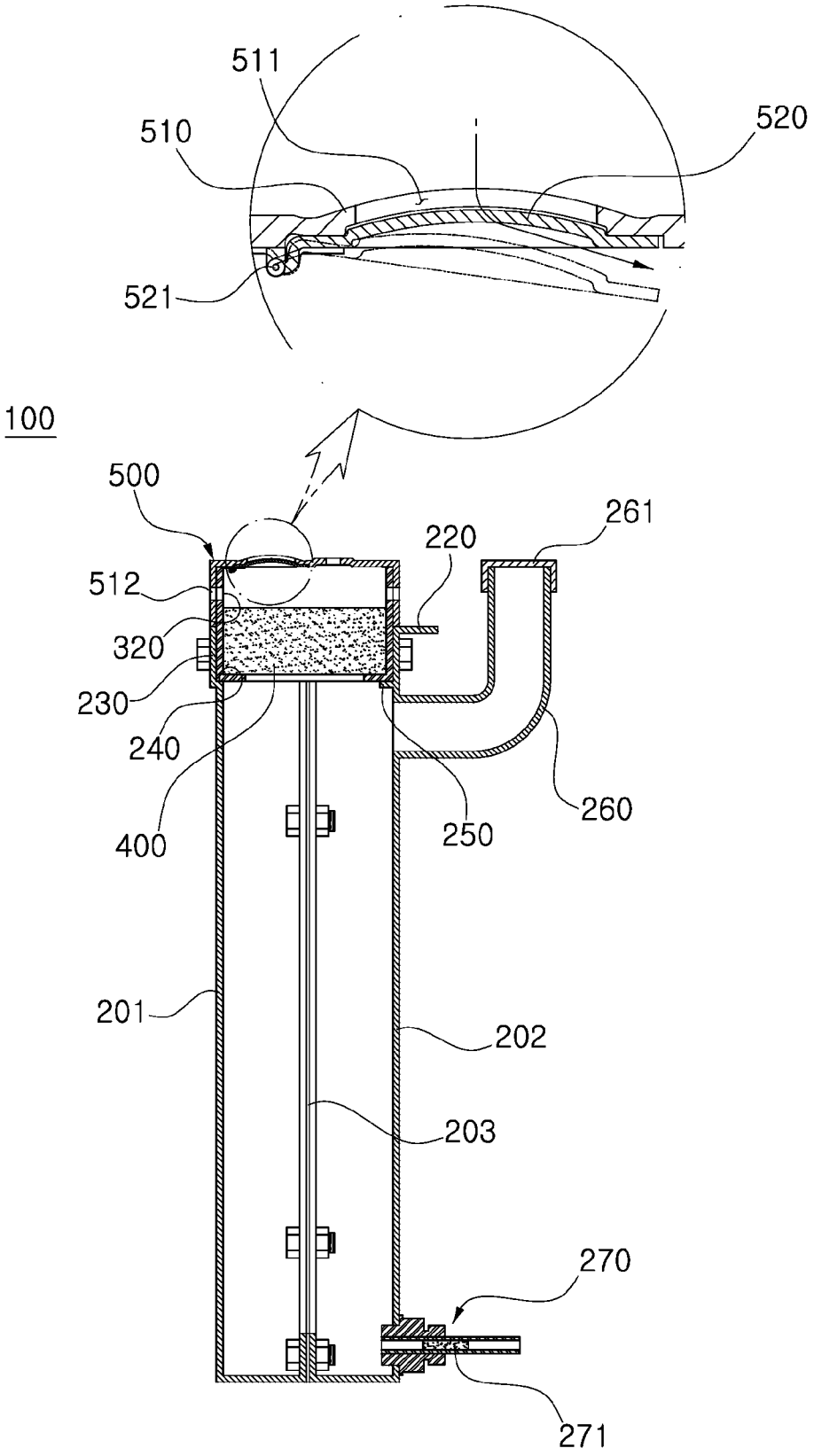
FIG. 3 is a cross-sectional view of FIG. 1.

Referring to FIGS. 1 to 3, the water collecting boundary block 100 according to the first embodiment of the present invention includes a body 200 in which a space portion 210 is formed to store rainwater, a grating 500 seated on an upper portion of the body 200, and a drain part 270 formed at one side of a lower end of the body 200 for supplying water into the ground.

Here, the body 200 and the grating 500 may be made of a metal material such as aluminum or stainless steel which does not easily rust.

The body 200 may be formed in a box shape of a hexahedron having an opened top. For example, the body 200 may be formed in a form of a cube shape having a length longer than a width. Inside the body 200, a space portion 210 in which water introduced from outside can be stored is formed. Urethane having a void or water permeable concrete can be received in the space portion 210.

At this time, the body 200 may be manufactured with two parts 201 and 202 divided in a width direction to reduce manufacturing cost, and then the body 200 may be joined by welding or bolting. A sealing member 203 such as rubber or silicone is attached or applied along a combining part to prevent water leakage at the two parts 201 and 202 by bolt fastening or the like.

However, it is only one embodiment of the present invention to fabricate the body 200 in two parts using a metal material as described above, and if necessary, the body 200 may be integrally formed. For example, the body 200 in a shape of a box can be injection-molded or vacuum-molded at one time by using synthetic resin such as rubber, vinyl or plastic.

In addition, a flange portion 220 having a predetermined width along a length direction of the body 200 is protruded outward at an upper end portion of one side in a width direction of the body 200. This flange portion 220 is to adjust depth of burial to a height of soil around a lower portion of column of the tree when the water collecting boundary block 100 is installed. Typically, the flange portion 220 can be constructed 50 mm lower than a floor of a sidewalk block.

An upper portion 230 of another side of the body 200 in the width direction is bent outward and extends upward to form a single step 240. At least one latching jaw 250 may protrude from an inner side of one side of the body 200 in the width direction facing the single step 240 for receiving a filter container 300 which will be mentioned later.

In addition, a water supply pipe 260 is formed on one side of the body 200 in the width direction to supply water to the space portion 210 of the body 200 from the outside. The water supply pipe 260 is formed under the flange portion 220 and spaced apart from the flange portion 220 to be connected to the space portion 210. The water supply pipe 260 extends outward from one side of the body 200 in the width direction, and then is bent upward to expose the upper end thereof to the ground. A cap 261 is coupled to an upper end of the water supply pipe 260 which is exposed to the ground, and water is supplied to the space portion 210 of the body 200 through the water supply pipe 260 by opening the cap 261 during use. For example, in the dry season such as drought, water is supplied to and stored in the space portion 210 of the body 200 through the water supply pipe 260, so that water can be continuously supplied to the ground through a drain part 270 described later.

A drain part 270 is formed at one side of a lower end of the body 200 so as to be connected with the space portion 210, so that water stored in the space portion 210 of the body 200 is supplied to the ground through the drain part 270. The drain part 270 may be a through hole formed at one side of the lower end of the body 200. As shown in the figure, a separate pipe member may be coupled to the through hole to form the drain part 270.

On the other hand, a flow control member may be installed on one side of the drain part 270 to control a flow rate of water supplied to the ground through the drain part 270. As an example, a water absorbing member 271 such as a cotton or a sponge is inserted into a tube of the drain part 270, and the flow rate of water supplied to the ground can be adjusted by appropriately selecting the specifications such as the material and the thickness of the water absorbing member 271. As another example, a synthetic tube (not shown) may be coupled to the drain part 270, and a separate flow regulator (not shown) may be provided on one side of the tube. For example, the flow regulator may be a fluid flow regulator that regulates flow rate per unit time by regulating a degree of pressurization of the tube during ringer shot. As another example, an open/close valve (not shown) for opening and closing the tube of the drain part 270 is installed on one side of the drain part 270, and flow rate of water per unit time of the water supplied to the ground through the drain part 270 is adjusted by controlling the open/close valve.

According to the first embodiment of the present invention, the filter container 300 is combined to the upper end of the body 200. The filter container 300 is made of a metal material such as aluminum or stainless steel and has a box shape with opened top, and a plurality of inlets 310 may be formed at a bottom surface thereof. A lower end of the filter container 300 is seated on the single step 240 of the body 200 and the latching jaw 250 when the filter container 300 is combined. The filter container 300 can be fixed by fasteners such as bolts fastened to a second fastening hole 301 formed on respective both sides of the filter container 300 in the width direction through a first fastening hole 204 on respective both sides of the body 200. In addition, a filter 400 such as a sponge is received in the filter container 300 to filter foreign substances flowing along with the rainwater to prevent foreign matter from flowing into the space portion 210 of the body 200.

A plurality of through holes 320 are formed at upper and lower ends of both sides of the filter container 300 in the width direction of the filter container 300 and are arranged along a length direction of the filter container 300. The through hole 320 is connected to a rainwater permeable port 512 formed on a side surface of a grating 500 which will be described later. And flows into the filter housing part 300 through the through hole 320 of the housing 300. Rainwater gathered at a lower portion of column of a tree is flowed into the filter container 300 through the rainwater permeable port 512 of the grating 500 and the through hole 320 of the filter container 300.

Meanwhile, as another example of the present invention, the filter container 300 can be injection-molded or vacuum-molded at one time by using synthetic resin such as rubber, vinyl or plastic. In this case, the filter container 300 may be separately formed and combined to the body 200 made of metal or synthetic resin, or the filter container 300 may be integrally injected or vacuum-molded together with the body 200.

The grating 500 is combined to an upper side of the filter container 300 and has a cover which has '∩' shaped cross-sectional shape wherein both longitudinal ends and bottom are opened, and a plurality of rainwater inlets 511 are formed in a grill form at a ceiling surface thereof, and a plurality of flaps 520 installed inside the ceiling of the cover 510 for opening and closing the rainwater inlet 511.

As described in FIG. 3, an upper end of the filter container 300 is received in the cover 510 when the grating 500 is combined. A lower end of the cover 510 at one side in the width direction is located on the flange portion 220 and the other lower end is supported by the upper portion 230 formed to extend outward-upwardly from the other surface of the body 200 in the width direction. At this time, it is of course possible to combine the body 200 and the grating 500 using a fastener such as a bolt.

The flap 520 may be formed of a metal plate such as aluminum or stainless steel, may be combined with a ceiling surface of the cover 510 in a hinge manner to be rotated in up-down direction, may be elastically supported in a direction toward the rainwater inlet 511 to open and close the rainwater inlet 511 by a torsion spring (not shown) interposed in a hinge shaft 521, and may be formed to have a curved surface corresponding to a curved shape around the rainwater inlet 511. Therefore, normally, the flap 520 closes the rainwater inlet 511 to prevent inflow of foreign matter such as dust and leaves. As described in enlarged view of FIG. 3, the flap 520 is rotated downward by the rainwater flowing into the rainwater inlet 511, and the rainwater inlet 511 is opened to allow the rainwater to flow into the grating 500.

Figure 4:
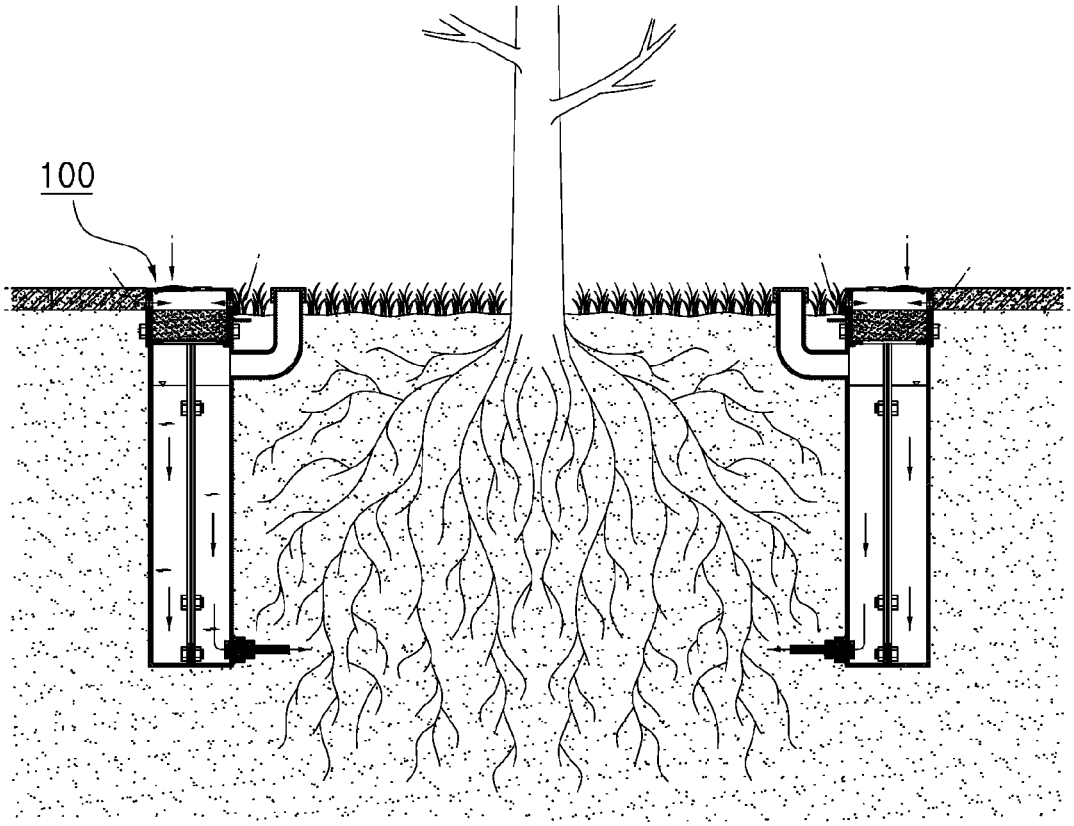
FIG. 4 is a use state diagram of a water collecting boundary block according to the first embodiment of the present invention.

FIG. 4 is a use state diagram of a water collecting boundary block according to the first embodiment of the present invention.

Referring to FIG. 4, the water collecting boundary block 100 according to the first embodiment of the present invention may be installed in the ground at a predetermined distance from a row of trees and may be installed at one side or both sides of the row of trees, so that it is possible to prevent damage to the road or the sidewalk block due to the growth of a root of the tree.

When the water collecting boundary block 100 is buried in the ground, the flange portion 220 can be constructed to be lower by about 50 mm than a floor of the sidewalk block. When it rains, rainwater flows inside through the rainwater inlet 511 on the top surface of the grating 500 and the rainwater permeable port 512 on the side.

Foreign substances introduced into the grating 500 are filtered by the filter 400 received in the filter container 300. The rainwater from which the foreign substances are removed is passed through the inlets 310 at the lower end of the filter container 300 and is stored in the space portion 210 of the body 200.

The rainwater stored in the space portion 210 of the body 200 is supplied to the ground through the drain part 270. A certain amount of rainwater can be continuously supplied to the ground by the flow control member provided in the drain portion 270 for a certain period of time.

If the amount of rainwater stored in the space portion 210 of the body 200 is insufficient due to a drought or the like, the cap 261 of the water supply pipe 260 protruding from the ground is opened, and water is supplied to the space portion 210 of the body 200 through the water supply pipe 260 to prevent the tree from died dry.

Second Embodiment

Figure 5:
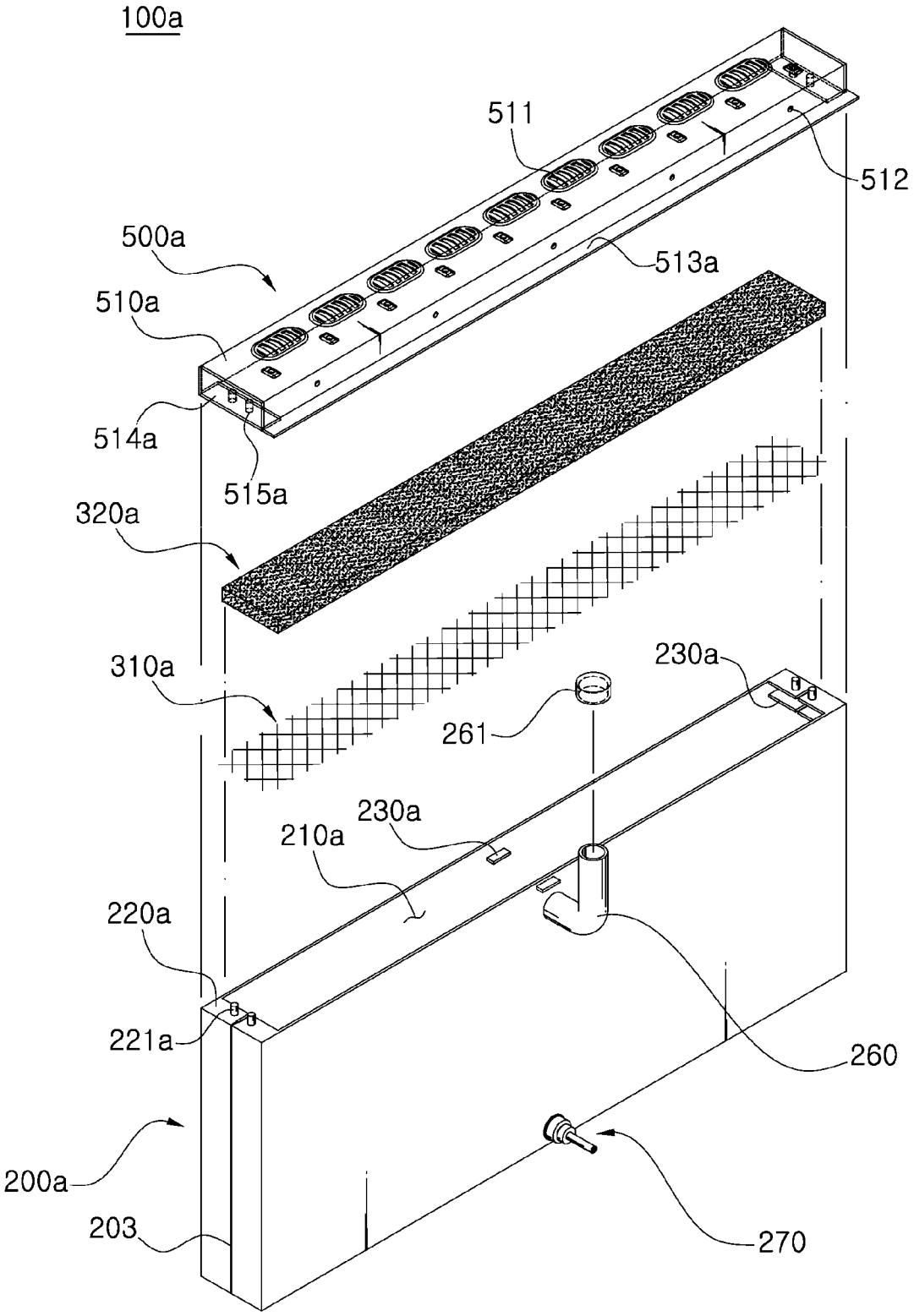
FIG. 5 is an exploded perspective view of a water collecting boundary block according to a second embodiment of the present invention.

FIG. 5 is an exploded perspective view of a water collecting boundary block according to a second embodiment of the present invention.

The water collecting boundary block 100*a* according to the second embodiment of the present invention is different from the first embodiment described above that there is no separate filter container 300, an inserting protrusion 221*a* at an upper end of the body 200*a* is inserted into a inserting groove 515*a* at a lower end of the grating 500*a*, and a mesh net 310*a* and a nonwoven filter 320*a* are interposed between the body 200*a* and the grating 500*a*

Therefore, the same reference numerals are assigned to the same elements as those of the above-described first embodiment, and a duplicate description thereof will be omitted. The second embodiment of the present invention will be described in detail, hereinafter.

According to the second embodiment of the present invention, the body 200*a* is formed with a seating portion 220*a* which is inwardly folded inwardly at both longitudinal ends of the body 200*a*, respectively. The seating portion 220*a* is provided with at least one inserting projection 221*a*. The inserting protrusion 221*a* is for coupling the body 200*a* with the grating 500*a* and therefore the inserting groove 515*a* is formed at the lower end of the grating 500*a* to be described later so as to correspond to the inserting protrusion 221*a*.

In addition, a supporting step 230*a* protrudes from both inner side surfaces in a width direction of the body 200*a* and inner side surfaces in a length direction of the body 200*a*. 320*a*. The supporting step 230*a* is for supporting a lattice net 310*a* and a nonwoven filter 320*a* which will be described later. Meanwhile, as in the first embodiment described above, a water supply pipe 260 is formed at the upper end of one side of the body 200*a*, and a drain part 270 is formed below the water supply pipe 260.

The nonwoven filter 320*a* for filtering foreign substances with rainwater is installed at the upper end of the body 200*a*. A lattice net 310*a* is seated in an opening of the upper end of the body 200*a*. At this time, the grating 310*a* is supported by a plurality of supporting protrusions 230*a* protruding from the inside of the body 200*a*, and the nonwoven filter 320*a* is seated on the lattice net 310*a*.

The grating 500*a* includes a cover 510*a* in a form of a box shape with opened bottom surface and a flap 520 which is elastically installed inside of a ceiling of the cover 510 so as to be rotatable in up-down direction.

A plurality of rainwater inlets 511 in a form of a grill are formed on an upper surface of the cover 510*a*, and a plurality of rainwater permeable ports 512 are formed on both sides of the cover. 510*a*.

A flange portion 513*a* having a predetermined width along the length direction is formed at a lower end of one side of the cover 510*a* in the width direction. A supporting portions 514*a* are formed by extending a predetermined length inwardly at both lower ends of the cover 510*a* in the length direction. The inserting groove 515*a* is formed in the supporting portion 514*a* so as to correspond to the inserting protrusion 221*a* described above. Accordingly, when the grating 500*a* is combined with the body 200*a*, the inserting protrusion 221*a* of the body 200*a* is coupled to the inserting groove 515*a*, so that flow of the grating 500*a* relative to the body 200*a* is prevented.

When it rains, the rainwater flows inside through the rainwater inlet 511 on the upper surface of the grating 500*a* and the rainwater permeable port 512 on the side surface, and then the foreign substances are filtered passing through the nonwoven filter 320*a*. The rainwater without the foreign substances passes through the grid 310*a*, is stored in the space portion 210*a* of the body 200*a*, and is supplied to the ground through the drain part 270.

Here, a predetermined amount of rainwater can be continuously supplied to the ground by a flow control member provided in the drain part 270, and water can be continuously supplied to the ground through the water supply pipe 260 in drought to prevent the tree from died dry as in the first embodiment.

Third Embodiment

Figure 6:
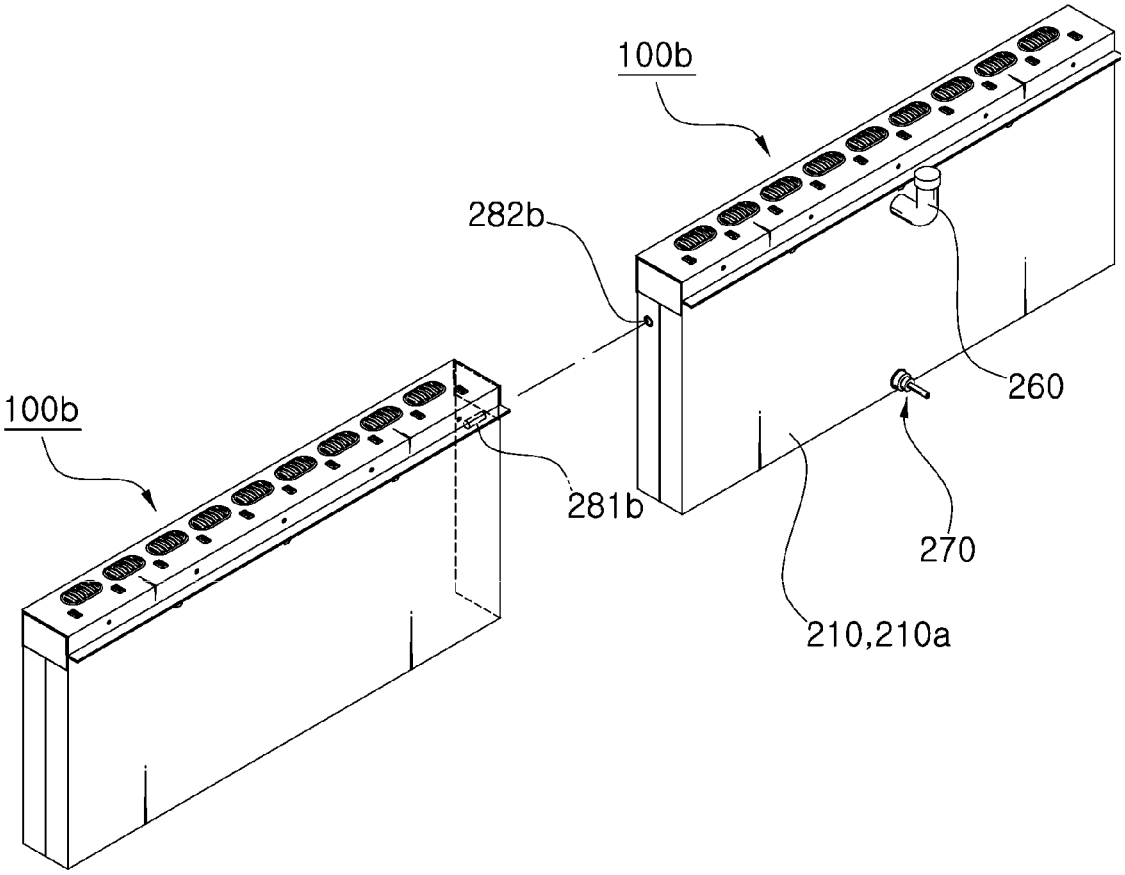
FIG. 6 is a perspective view of a water collecting boundary block according to a third embodiment of the present invention.

FIG. 6 is a perspective view of a water collecting boundary block according to a third embodiment of the present invention. Hereinafter, the same reference numerals are assigned to the same elements having the same functions as those of the above-described embodiment, and redundant description will be omitted.

According to the third embodiment of the present invention, by connecting a plurality of water collecting boundary blocks 100*b* in series or in parallel, when the amount of water flowing into any one water collecting boundary block 100*b* exceeds the storage capacity, the water can be flow to other water collecting boundary blocks and stored therein.

For this, in the water collecting boundary block 100*b* according to the third embodiment of the present invention, a connecting port 281*b* connected to the space portions 210 and 210*a* is formed at an upper end of one side of the bodies 200 and 200*a* in the length direction, and a connecting hole 282*b* is formed in an upper end of the other side so that the connecting hole 281*b* of the adjacent water collecting boundary block 100*b* is inserted.

For example, when two water collecting boundary blocks 100*b* are connected in series in the length direction as shown in FIG. 6, the connecting port 281*b* formed in the water collecting boundary block 100*b* on the left side in the drawing is inserted into the connecting hole 282*b* formed in the water collecting boundary block 100*b* on the right side in the drawing, so that water stored in the left water collecting boundary block 100*b* can flow through the connecting port 281*b* to the right water collecting boundary block 100*b*.

Figure 7:
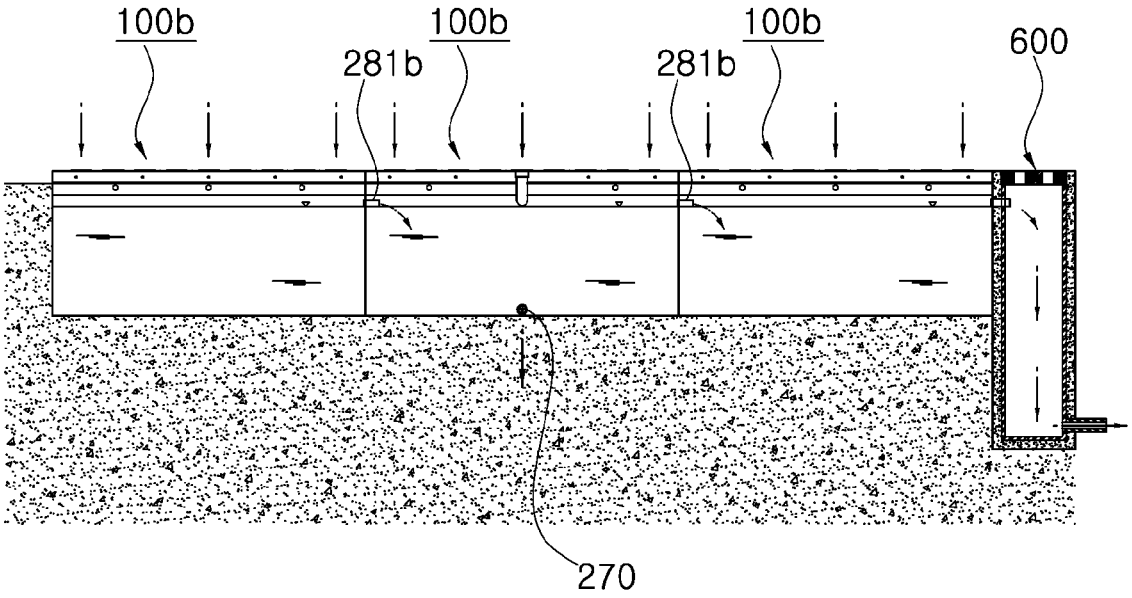
FIG. 7 is a use state diagram of the water collecting boundary block according to the third embodiment of the present invention.

FIG. 7 is a use state diagram of the water collecting boundary block according to the third embodiment of the present invention.

Referring to FIG. 7, an example in which three water collecting boundary blocks 100*b* are connected in series is shown, but the number of water collecting boundary blocks 100*b* can be appropriately selected as needed.

At this time, in order to prevent water from leaking into the ground through the connecting hole 282*b*, the connection hole 282*b* of the leftmost water collecting boundary block may be closed or not be formed.

In addition, a drain part 270 for supplying water to the ground and a water supply pipe 260 for supplying water to the ground in drought may be formed in any one of a plurality of water collecting boundary blocks 100*b* connected in series as shown in FIG. 7. Alternatively, the water supply pipe 260 and the drain part 270 may be formed in a plurality of the water collecting boundary blocks 100*b*.

In addition, as described in FIG. 7, the connecting port 281*b* of the water collecting boundary block 100*b* is connected with a drain pipe 600. When the amount of water flows into the water collecting boundary block 100*b* exceeds storable capacity, the exceed water may drain to the sewer through the drain pipe 600.

In the above embodiment, the plurality of water collecting boundary blocks 100*b* are directly coupled through the connecting port 281*b* and the connecting hole 282*b*. Alternatively, the connecting port 281*b* and the connecting hole 282*b* may be connected by a separate hollow pipe (not shown).

In addition, although the plurality of water collecting boundary blocks 100*b* are connected in series in the length direction in the above embodiment, the connecting part 281*b* and the connecting hole 282*b* may be formed on one side and the other side of the body 200 and 200*a* in the width direction to connect the plurality of water collecting boundary blocks 100*b* in parallel in the width direction of the bodies 200 and 200*a*.

Figure 8:
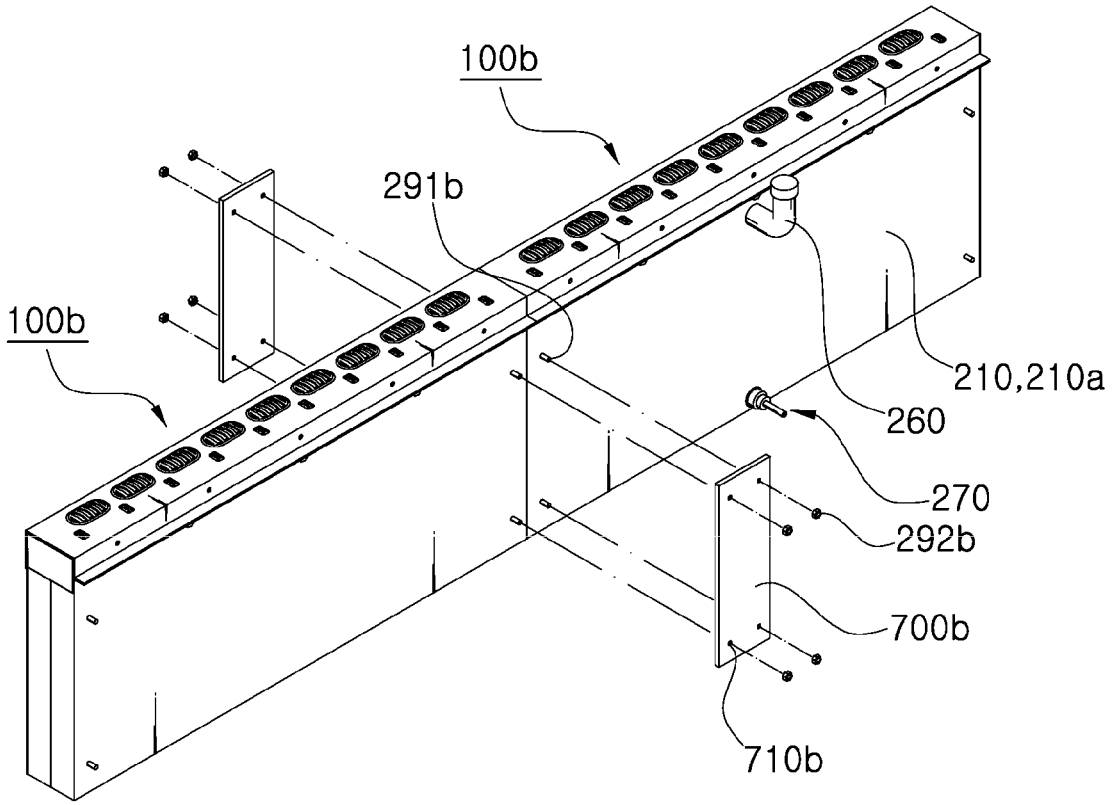
FIG. 8 is a view of combination of the water collecting boundary block according to a third embodiment of the present invention.

FIG. 8 is a view of combination of the water collecting boundary block according to a third embodiment of the present invention.

Referring to FIGS. 6 and 7, as described above, the plurality of water collecting boundary blocks 100*b* can be directly combined to each other by a connecting port 281*b* and the connecting hole 282*b* respectively formed on both sides of the body 200 and 200*a* in a length direction.

At this time, in order to further strengthen the coupling between the adjacent pair of the water collecting boundary blocks 100*b*, as shown in FIG. 8, a combining bracket 700*b* may be combined to an outer side of the body 200, 200*a* so as to cover a boundary line of combination. For this, at least one combining part 291*b* protrudes from one side or both sides of the body 200, 200*a* in the width direction, and the combining part 291*b* is coupled to the combining bracket 700*b*. For example, after the combining part 291*b* is inserted into a combining hole 710*b* of the combining bracket 700*b*, the combining member 292*b* such as a nut is screwed to the combining part 291*b* from the outside of the combining bracket 700*b*. Thus, a pair of adjacent water collecting boundary blocks 100*b* can be firmly coupled by the combining bracket 700*b*.

Figure 9:
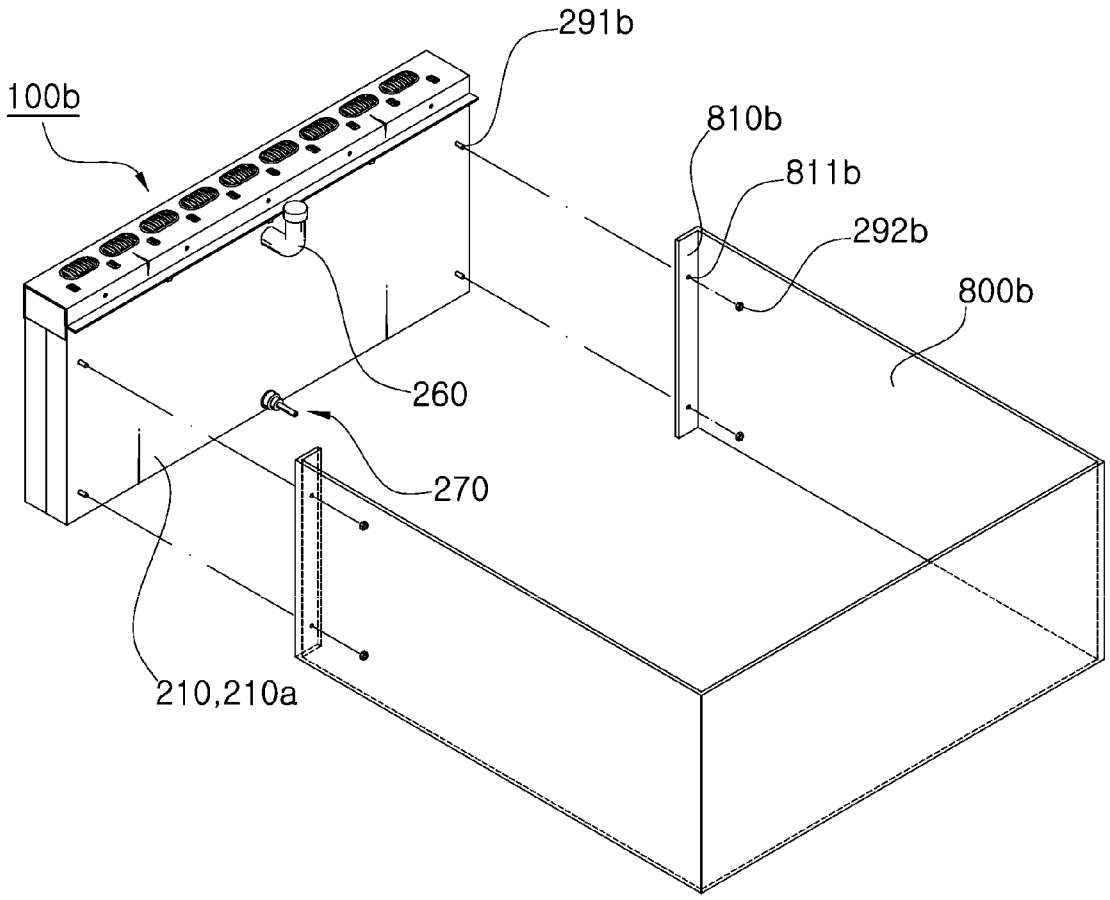
FIG. 9 is a view showing combination of the water collecting boundary block and a root expansion preventing member according to the third embodiment of the present invention.

FIG. 9 is a view showing combination of the water collecting boundary block and a root expansion preventing member according to the third embodiment of the present invention.

According to the third embodiment of the present invention, as shown in FIG. 9, a root expansion preventing member 800*b* having a 'C' shape is installed so as to surround the three sides of the tree, and the water collecting boundary block 100*b* is installed at opened one side of the tree so as to surround the four sides of the tree so as to prevent breakage of the sidewalk blocks and roads due to the expansion of the tree.

At this time, bent portions 810*b* at both ends of the root expansion preventing member 800*b* are formed with through holes 811*b*. The combining part 291*b* of the water collecting boundary block 100*b* may be inserted into the combining hole 811*b* and then fixed with a combining member 292*b* such as a nut.

In addition, although the three sides of the tree are surrounded by the root expansion preventing member 800*b* and one water collecting boundary block 100*b* is provided in the other direction in the embodiment shown in FIG. 9, this is only an embodiment of the present invention. For example, L-shaped root expansion preventing member 800*b* may be disposed to surround the two sides of the tree, and a pair of water collecting boundary blocks 100*b* may be arranged at a right angle to surround the other two directions. The shape of the root expansion preventing member 800*b* and the arrangement type, and the number of the water collecting boundary block 100*b* can be appropriately selected as needed.

The foregoing is illustrative of the inventive concept and is not to be construed as limiting thereof. Although a few exemplary embodiments of the invention have been described, those skilled in the art will readily appreciate that many modifications are possible in the exemplary embodiments without materially departing from the novel teachings and advantages of the inventive concept. Accordingly, all such modifications are intended to be included within the scope of the inventive concept as defined in the claims.

INDUSTRIAL APPLICABILITY

According to the water collecting boundary block according to the present invention, it is possible to prevent desertification in urban areas and death of a tree.

In addition, according to the water collecting boundary block according to the present invention, collecting efficiency can be improved, and amount of water supplied to the ground through the drain part can be adjusted.

In addition, according to the water collecting boundary block according to the present invention, water can be continuously supplied to the ground even in drought and the like.

The invention claimed is:

1. A water collecting boundary block, comprising:

a body having an opened upper portion and a space portion formed therein;

a grating which is seated on the body, and through which a plurality of rainwater inlets are formed;

a drain part formed at one side of a lower end of the body so as to be connected to the space portion, to provide water stored in the space portion to a ground; and a water supply pipe connected to the space portion and formed at an upper portion of the drain part, and wherein a cap is combined with an upper portion of the water supply pipe which is exposed to the ground to provide water to the space portion.

2. The water collecting boundary block of claim 1, wherein the drain part comprises a flow control member for regulating an amount of water supplied to the ground.

3. The water collecting boundary block of claim 1, further comprising a urethane having a void or a water-permeable concrete, and received in the space portion.

4. The water collecting boundary block of claim 1, further comprising a connecting part is formed at one side of an upper portion of the body so as to be connected with the space portion, to flow out water to another adjacent water collecting boundary block or a drain pipe when water in the space portion is full.

5. The water collecting boundary block of claim 4, further comprising a connecting hole formed at the other side of the upper portion of the body so as to be connected with the connecting part.

6. The water collecting boundary block of claim 1, further comprising a combining part for combination with a root expansion preventing member or a combination bracket.

7. The water collecting boundary block of claim 1, further comprising a filter container having a bottom surface and side walls in which a filter is received and combined with an upper side of the space portion, wherein a plurality of inlets are formed at the bottom surface of the filter container.

8. The water collecting boundary block of claim 1, wherein the water supply pipe extends outward from one side of the body in the width direction, and then is bent upward to expose the upper end thereof to the ground.

9. A water collecting boundary block, comprising:

a body having an opened upper portion and a space portion formed therein;

a grating which is seated on the body, and through which a plurality of rainwater inlets are formed; and a drain part formed at one side of a lower end of the body so as to be connected to the space portion, to provide water stored in the space portion to a ground, wherein the grating comprises a cover having a plurality of rainwater inlets formed at a ceiling surface thereof, and a plurality of flaps which are combined with inner side of the ceiling surface in a hinge manner to be rotated in up-down direction; and the flap is elastically supported in a direction toward the rainwater inlets to open and close the rainwater inlets.

10. The water collecting boundary block of claim 9, wherein the body comprises a seating portion respectively formed by inwardly bended at both upper ends of the body in a longitudinal direction, at least one inserting protrusion protruded from the seating portion and at least one supporting step protruded from an inner side surface thereof; and a lattice net is seated on an upper side of the supporting step, and a nonwoven filter is seated on an upper side of the lattice net.

11. The water collecting boundary block of claim 10, wherein the cover has a form of a box with opened bottom;

the cover comprises a flange portion protruded outward and extending a length direction so as to have a predetermined width at a lower end of one side in a width direction, a supporting portion extending inwardly by a predetermined length at both ends in the length direction, and a inserting groove formed at the supporting portion; and when the body and the grating are combined, the inserting protrusion of the body is coupled to the inserting groove of the cover to prevent the grating from flowing.

* * * * *